United States Patent [19]

Falcimaigne

[11] Patent Number: 4,462,717

[45] Date of Patent: Jul. 31, 1984

[54] RISER FOR GREAT WATER DEPTHS

[75] Inventor: Jean Falcimaigne, Bois-Colombes, France

[73] Assignee: Institut Francais du Petrole, Rueil-Malmaison, France

[21] Appl. No.: 387,634

[22] Filed: Jun. 11, 1982

[30] Foreign Application Priority Data

Jun. 12, 1981 [FR] France ..... 81 11790

[51] Int. Cl.[3] ..... E21B 43/01

[52] U.S. Cl. ..... 405/195; 166/350; 405/224

[58] Field of Search ..... 405/195, 224; 166/350, 166/359, 367

[56] References Cited

U.S. PATENT DOCUMENTS

| | | | |
|---|---|---|---|
| 3,517,110 | 6/1970 | Morgan | 166/350 X |
| 4,212,561 | 7/1980 | Wipkink | 405/195 |
| 4,332,509 | 6/1982 | Reynard et al. | 405/195 |

*Primary Examiner*—David H. Corbin

[57] ABSTRACT

A riser connects a stationary submerged structure such as an offshore oil well head with a caisson of positive buoyancy anchored to the water bottom. The riser comprises continuous guide means extending from the caisson to a certain distance above the submerged structure and housing, with a clearance from the bottom transfer lines connecting said structure to the caisson, and holding means joining together said guide means and at least one anchoring line of the caisson.

20 Claims, 7 Drawing Figures

FIG.1
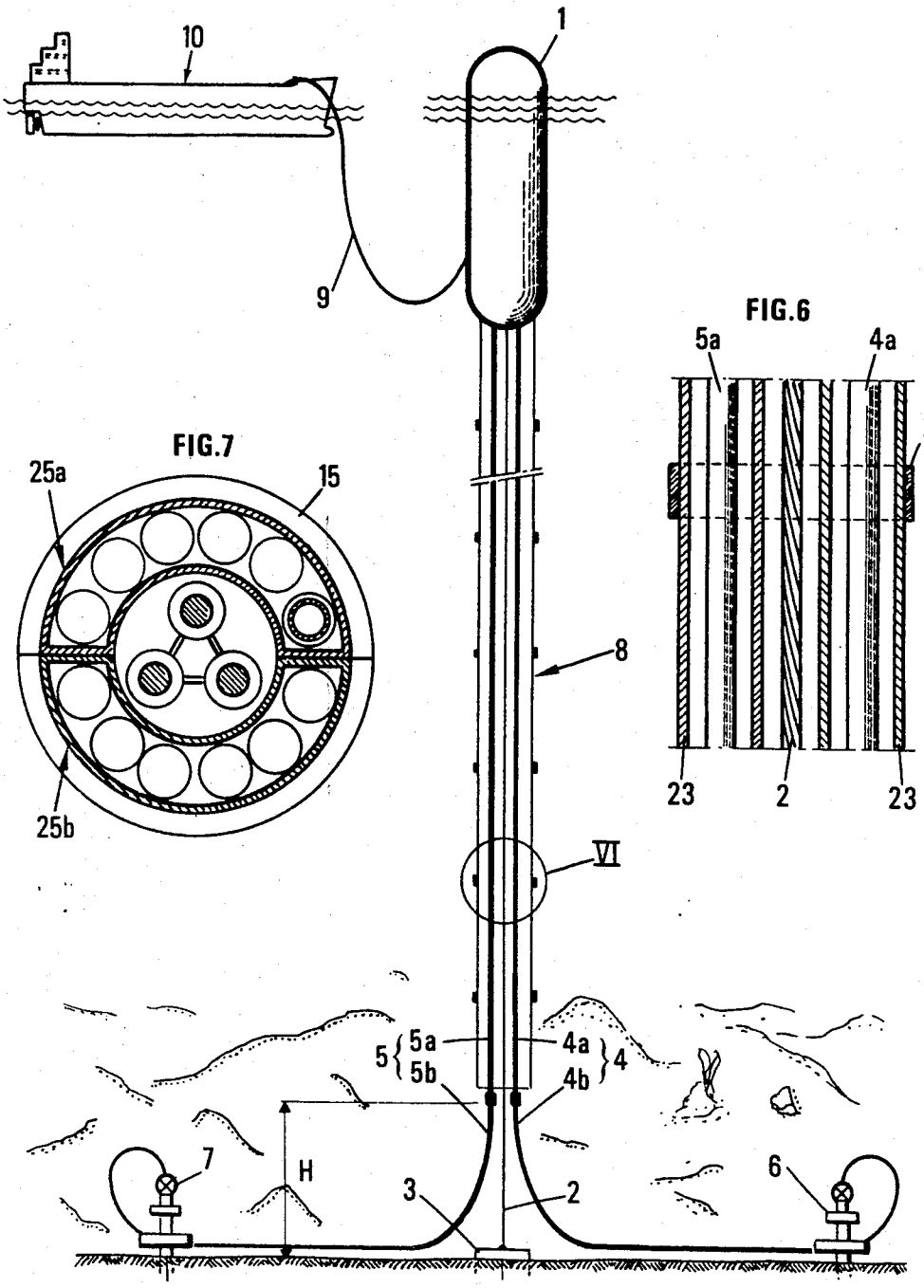
FIG.6
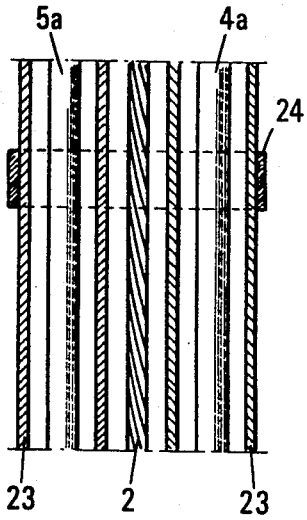
FIG.7

RISER FOR GREAT WATER DEPTHS

BACKGROUND OF THE INVENTION

This invention concerns a riser pipe, hereinafter called merely riser, for use at great water depths, giving passage to transfer lines connecting a submerged structure such as a submerged oil well to a caisson of positive buoyancy.

It is known in the art to make use of risers for transferring the production of a submerged oil well.

According to a first embodiment of the prior art illustrated for example, by French patent application No. 2,344,442, a flexible line connects the submerged fluid source to a buoy anchored by means of several cables. The length of the line is greater than the distance between the buoy and the water bottom, so that the line is not stretched. According to another embodiment, illustrated by the French patent application No. 2,199,053, there is used at least one line stretched by means of at least one buoy to which it is connected, said buoy being either floating or submerged as illustrated in the French Pat. No. 2,303,702.

These risers can be used at water depths not in excess of 200 to 300 meters. Beyond these values, the movement of the buoy generates excessively high overtensions in the risers of the first type, whereas the dilatations of the line would result in unacceptable displacements of the buoy for the risers of the second type.

The riser according to the present invention avoids these disadvantages and, accordingly, can be used at great water depths reaching or even exceeding 3000 meters.

SUMMARY OF THE INVENTION

The riser according to the invention is adapted to connect to a stationary submerged structure, a caisson of positive buoyancy connected to the water bottom through at least one anchoring line. This riser is supported in the water by the caisson and comprises holding means for joining together, from the caisson, over a length smaller than the distance between the caisson and the water bottom, at least one continuous guide means wherein is housed, with a certain clearance, at least one transfer line connecting the submerged structure to the caisson. The clearance enables the free displacement of the transfer line with respect to the guide means, and with respect at least one anchoring line of the caisson.

The guide means avoids the tangling up of the transfer lines, when the riser comprises several of such lines, and facilitates the replacement of a damaged line.

The holding means avoids the dispersion of the guide means and secure the guide means to the anchoring line; optionally they may transmit to the anchoring line the stresses resulting from the weight of the guide means.

Such an arrangement enables operation at great depth, since nothing impedes the dilatation of the transfer lines which are suspended from the buoy and since the guide means are interrupted at a certain distance from the bottom. Thus, it is possible to compensate for length variations of these lines due to their dilatation by a variation of the curvature radius of the lower portion of the transfer lines, said lower portion being flexible or deformable.

On the contrary, when the guide means extend down to the submerged structure, as it is the case according to U.S. Pat. No. 3,612,177, the dilatation of the transfer lines initiates compression forces which may result in the breaking of said transfer lines.

Such a risk is also likely to occur with the devices described in U.S. Pat. Nos. 3,894,567 and 3,934,289, where the transfer lines are rigidly secured to the guide means. Moreover, according to the U.S. Pat. No. 3,612,177, the floating installation must be located vertically above the submerged structure. This disposition, which is the more difficult to achieve as the distance separating the floating installation from the submerged structure is greater, is by no means necessary according to the present invention. Finally, with the system described in this prior patent, at least two connections have to be affected when positioning the riser: one between the riser itself and the central submerged structure, the other between the transfer line and the well head, whereas with the riser according to the present invention, it is sufficient to effect this latter connection.

The riser according to the invention may comprise several transfer lines having different functions. Some of them, for example, may be ducts used to convey to the buoy a fluid delivered by a submerged structure, or conversely, to convey a fluid to a submerged structure, for example a fluid facilitating the exploitation of an oil well, or a fluid under pressure controlling or actuating apparatuses of the submerged structure. Other transfer lines will consist, for example, of electric cables for supplying electric power to the submerged structure. The riser may also be used for transferring certain things from the buoy to the submerged structure and conversely.

Optionally, transfer means are associated with the buoy to provide for its connection with a floating installation such as a tanker.

BRIEF DESCRIPTION OF THE DRAWINGS

The invention will be better understood and all its advantages will be made apparent from the following description illustrated by the accompanying drawings wherein:

FIG. 1 diagrammatically shows the riser according to the invention for transferring to the surface the oil production from an oil field submerged at great depth, FIG. 6 shows in cross section an enlarged detail of the transfer riser of FIG. 1, and, FIG. 7 is a cross-section along line IV—IV of FIG. 3 and shows an alternative of the embodiment illustrated in FIG. 4.

DETAILED DISCUSSION OF THE INVENTION

Figure 2:
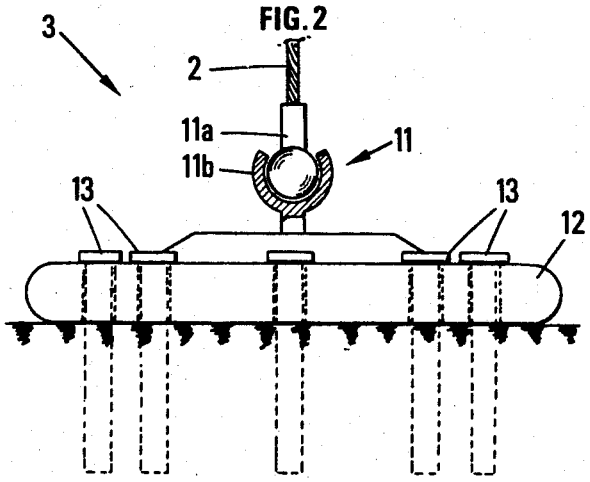
FIG. 2 illustrates an embodiment of the anchoring point.

The riser according to the invention, used for transferring the production of an oil well submerged at great depth, is diagrammatically shown in FIG. 1.

Reference 1 designates a floating buoy maintained in position by a stretched anchoring line 2, one end of which is secured to the buoy and the other end secured to a stationary point at the water bottom, for example, through an anchor, i.e. a plate secured to the bottom or an anchor member 3. Transfer lines designated by references 4 and 5 are suspended from the buoy 1 and communicate with submerged fluid sources such as wells 6 and 7 of an oil field. The upper portions 4*a* and 5*a* of the transfer lines 4 and 5 are continuously guided through guide means 23 (FIG. 6) maintained themselves along the anchoring line 2 through holding means 24 (FIG. 6).

Reference 8 designates the assembly formed by the guide means 23 and the holding means 24.

The lower portions 4*b* and 5*b* of the transfer lines 4 and 5 are flexible and formed, for example, in the case of fluid transfer, of reinforced flexible ducts. Connection means 9 comprising at least one transfer line in communication with ducts 4 and 5, provide for the transfer of fluid or electric power between the buoy 1 and the ship 10.

In the embodiment illustrated in FIG. 1, the buoy 1 is a floating buoy, but it would not be outside the scope of this invention to submerge said buoy at a sufficient depth so as to protect it against the action of the wind, of the swells or of the surface currents.

The buoy has a sufficient buoyancy to support the apparent weight in water of ducts 4 and 5, of the guide means 23, of the holding means 24, of the anchoring line 2, and to stretch the latter. Said buoy, which forms, for example, a loading station for oil tanker, may be of any known type, such as for example, but not limitatively, as that described in the French patent application No. 2,413,536.

The anchoring line 2 is advantageously formed of a metal cable of sufficient cross section to withstand the tensile stresses resulting from the buoyancy of the buoy 1. Preferably, as shown in FIG. 2, the lower end of the anchoring line 2 is secured to one element 11*a* of an articulation 11, the other element 11*b* of which is rigidly secured to a base plate 12 anchored in the water bottom through piles 13.

The anchoring line 2 may also consist of a flexible duct, a rigid stem or a tube formed of end-to-end secured sections.

Figure 3:
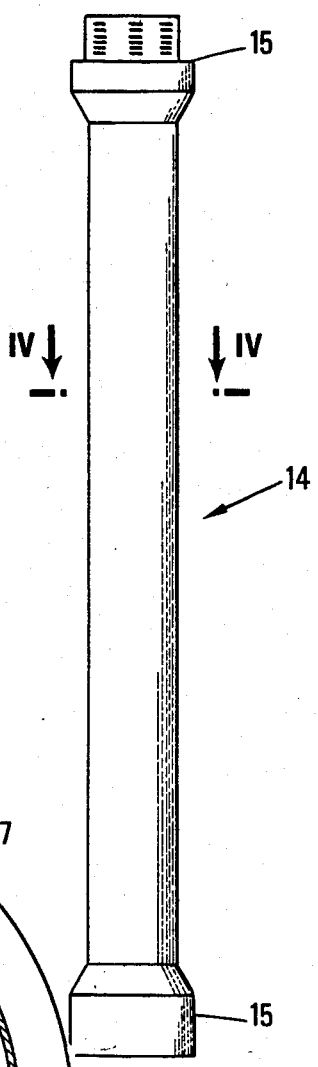
FIG. 3 shows a constituting element of the guide means.

The guide means 23 and the holding means 24 may be joined in a single assembly; they may comprise for example, tubular elements 14, such as that shown in FIG. 3. These tubular elements are secured to one another through joints 15 of the bayonet type which are well known in the art and need not to be described in detail, the upper element being secured to the buoy 1 through a complementary bayonet joint (not shown).

In order to reduce the weight of the guide means 23 and of the holding means 24, the latter may be formed of light materials, for example, titanium alloys, composite materials formed of thin metal sheets or of organic or inorganic fibers embedded in a resin. In this latter case, the fixation to the metal joint elements 15 is achieved by any known method, for example, sticking by means of special glues.

Figure 4:
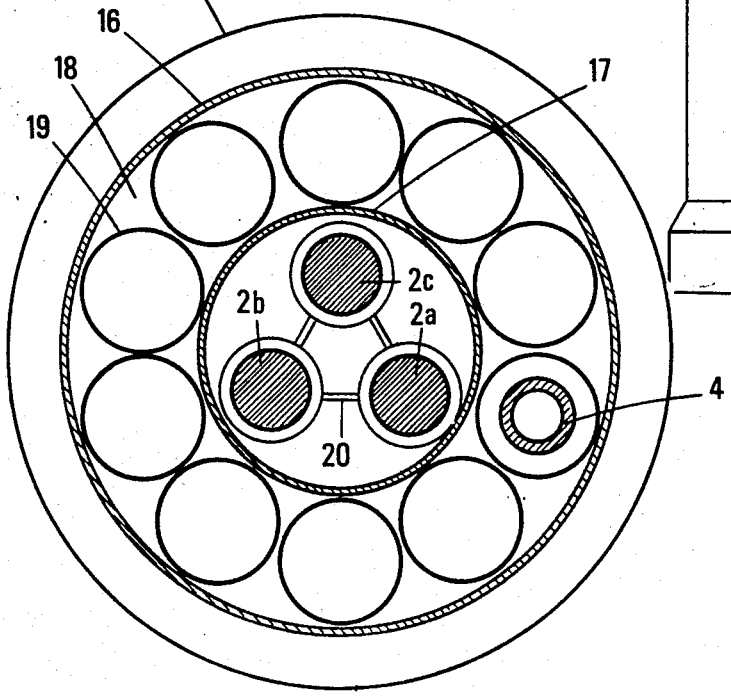
FIG. 4 is a cross-section along line IV—IV of FIG. 3.

According to an embodiment illustrated in FIG. 4, the holding means 24 comprises an external tube 16 and an internal tube 17, coaxially arranged and defining therebetween an annular space 18. In the annular space 18 are located the guide means 23 formed of tubular sheaths 19 adapted to accommodate the transfer lines such as duct 4. For this purpose, the inner diameter of each sheath 19 is greater than the external maximum diameter of the transfer line housed therein. The axes of the tubular sheaths 19 are parallel to the axis of the anchoring line. It is however still possible to arrange these sheaths helically with a very wide pitch, around the central axis substantially parallel to the anchoring line 2.

According to an alternative embodiment, the annular space 18 may be tight or filled with a foam of low density to reduce or even nullify the apparent weight of the guide means 8 in water.

Inside tube 17 is placed the anchoring line 2. In the embodiment illustrated in FIG. 4, this anchoring line 2 is formed of three steel cables 2*a*, 2*b* and 2*c* maintained parallel and in spaced apart relationship, through bracing systems 20.

According to another embodiment, the assembly illustrated in FIG. 4 may be formed of two parts 25*a* and 25*b* (FIG. 7) or more, the latter being wound around the anchoring line when positioning the riser.

The guide means 23 guides the transfer lines 4 and 5 up to a distance H from the water bottom of at most 300 meters and, preferably, from 50 to 200 m.

The upper portions 4*a* and 5*a* of ducts 4 and 5 which are maintained around the anchoring line 2 through holding means 24, may be rigid ducts formed of end-to-end sections joined through connectors of any known type. These duct sections may also be formed of a composite material such as organic or inorganic fibers, embedded in a resin.

The lower portions 4*b* and 5*b* of the transfer lines 4 and 5 are constituted of flexible transfer lines, optionally reinforced, of any known type and of a sufficient length for having, at each point, a curvature radius greater than the minimum curvature radius that the transfer line may withstand without damage.

Figure 5:
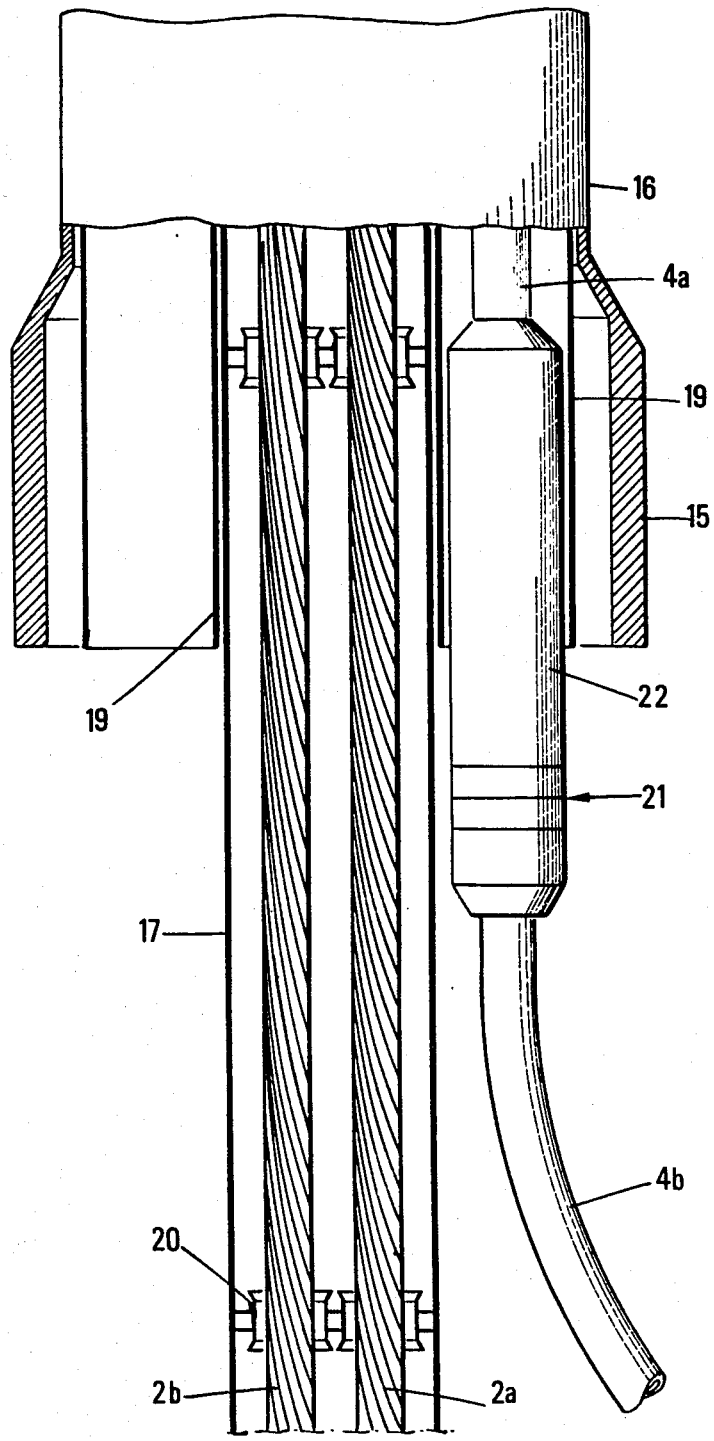
FIG. 5 shows a vertical cross-section of the riser at the level of the free end of the guide means.

FIG. 5 is a cross-sectional view of the riser at the level of the end of the guide means. The figure shows the connection of the upper portion 4*a* to the lower portion 4*b* which is effected through a connector 21 of any known type.

The portion 22, immediately adjacent to the connector 21, may have an external diameter slightly lower than the internal diameter of the sheath 19, as well as a length at least equal to the maximum length variation of the upper portion 4*a* of the transfer line 4 during the use of the riser according to the invention.

According to alternative embodiment, the holding means 24 are formed of flanges or straps coupling the guide means to the anchoring line. These flanges or straps being distant from each other define therebetween riser sections 8. In order to avoid their fall, they are secured either to the anchoring line or to the guide means 23. They will permit, inasmuch as possible, a free axial displacement of the guide means 23 with respect to the anchoring line 2. As a matter of fact, this is not always possible since, beyond a certain length of the guide means and in accordance with the material used, the latter is likely to break by the effect of its own weight, so that it is necessary to transfer to the anchoring line the stresses resulting from the weight of the guide means.

This will be advantageously achieved by rigidly securing at least a certain number of flanges or straps, both to the anchoring line 2 and to the guide means 23.

According to another embodiment and when the anchoring line is formed of several elements, it is possible to guide at least some of them up to the anchoring point 3. This enables, in the case where one of them is damaged, to replace it.

As a matter of fact, among other advantages, the guide means provides for an easy positioning and replacement of the transfer lines as well as of the elements of the anchoring line.

Optionally, the anchoring line 2 may be protected up to the anchoring point 3 by an extension of the inner tube 17 of the guide means.

Of course, modifications may be brought without departing from the scope of the present invention.

For example, the tranfer lines 4 may be used in any number different from that illustrated in the figures. The guide means may be of different diameters depending optionally of the guided transfer lines. The transfer lines 4 or 5, may be connected to an installation producing a fluid and resting on the water bottom or stationary with respect thereto. Particularly, the installations may be oil wells, submerged reservoirs, an installation delivering oil products after separation of liquid and gaseous hydrocarbons etc.

The transfer lines which are constituted of ducts 4, may convey the same product or different products.

The guide means 23 may consist merely of tubular sheaths, optionally perforated in order to decrease their weight. Of course the sheath may also be made of any other material such for example as meshed lattice.

Finally, the buoy 1 may comprise a reservoir and/or any material adapted for the treatment of the fluid product conveyed through the riser from the water bottom.

It is of course possible, when the anchoring line is composed of several elements, to accommodate at least some of them in the guide means 23, without necessarily requiring that the latter extend up to the anchoring point 3.

What is claimed is:

1. A riser adapted to connect at least one stationary submerged structure to a caisson of positive buoyancy fastened to the water bottom through at least one anchoring line, and with said riser being supported in water by said caisson, said riser comprising holding means (24) for joining together, from the caisson (1), and over a length smaller than the distance separating the caisson (1) from the bottom, at least one continuous guide means (23), wherein is accommodated, with a certain clearance, at least one transfer line (4), connecting the submerged structure (6) to the caisson, said clearance enabling free axial displacement of said transfer line with respect to said guide means, and at least one anchoring line (2) of the caisson (1), and with said guide means terminating, at a distance H from the bottom in a manner such as to permit free dilatation of said at least one transfer line (4).

2. A riser according to claim 1, wherein said holding means comprises a tubular casing (16) surrounding said continuous guide means (23) and said anchoring line (2).

3. A riser according to claim 1, wherein said continuous guide means (23) comprises a tubular sheath (19).

4. A riser according to claim 1, wherein said guide means engages said transfer line for guiding thereof at a distance of up to 300 meters from the water bottom, and said engaging distance being said distance H.

5. A riser according to claim 4, wherein said guide means engages said transfer line for guiding thereof at a distance from the water bottom between 50 and 200 meters, and said engaging distance being said distance H.

6. A riser according to claim 1, wherein the guide means and the holding means are suspended from said caisson and comprise a central tubular element surrounding said anchoring line, an external tubular element coaxial to the central tubular element and defining therewith an annular space, at least one tubular sheath placed in said annular space and adapted to accommodate said transfer line with a certain clearance.

7. A riser according to claim 6, wherein said sheath is located parallel to the axis of said tubular elements.

8. A riser according to claim 6, wherein said sheath is helically wound in a manner having a wide pitch about the axis of said tubular elements.

9. A riser according to claim 6, wherein said annular space is filled with foam and confers to the guide means a low or zero apparent weight in water.

10. A riser according to claim 1, wherein the anchoring line comprises several elements, and is arranged such that at least one of said elements is guided by guide elements in a continuous manner from the caisson down to the vicinity of the anchoring point.

11. A riser according to claim 1, wherein said holding means comprises flanges or straps spaced apart at a certain distance from one another.

12. A riser according to claim 2, wherein said tubular casing is formed of one or more tubular elements.

13. A riser according to claim 3, wherein said sheath is formed of one or more tubular elements.

14. A riser according to claim 1, wherein at least one of said at least one transfer line is made of composite material of thin metal sheets.

15. A riser according to claim 1, wherein at least one of said at least one transfer line is made of a titanium alloy.

16. A riser according to claim 3, wherein the sheath is made of plastic material.

17. A riser according to claim 1, wherein at least one of said at least one transfer line is made of composite material of at least one of organic and inorganic fibers embedded in a resin.

18. A riser according to claim 1, wherein said anchoring line is connected to an anchor at the bottom by means of an articulable connection.

19. A riser according to claim 1 wherein said at least one transfer line comprises a plurality of transfer lines, with each of said transfer lines comprising a rigid portion extending within said guide means and a flexible portion extending below the termination point of said guide means to connect to the submerged structure.

20. A riser according to claim 1 wherein said riser comprises a plurality of interconnected sections.

* * * * *